US006050268A

United States Patent [19]

San Filippo

[11] Patent Number: 6,050,268

[45] Date of Patent: Apr. 18, 2000

[54] PLIABLE DUAL CLAMPING CIGAR/CIGARETTE HOLDER

[76] Inventor: Keith San Filippo, 221 Windsor Dr., Bartlett, Ill. 60103

[21] Appl. No.: 09/221,439

[22] Filed: Dec. 28, 1998

[51] Int. Cl.[7] ..... A24F 9/14; A24F 13/02

[52] U.S. Cl. ..... 131/257; 131/190; 131/187

[58] Field of Search ..... 131/329, 256, 131/257, 258, 259, 235.1, 175, 178, 187, 190; D27/102, 103, 104, 136, 183; 294/99.1, 99.2, 100; 267/164; 24/552

[56] References Cited

U.S. PATENT DOCUMENTS

| | | | |
|---|---|---|---|
| 1,840,255 | 1/1932 | Rinne . | |
| 1,936,431 | 11/1933 | Halapeus . | |
| 2,736,322 | 2/1956 | Ford . | |
| 5,524,646 | 6/1996 | Reich . | |
| 5,842,481 | 12/1998 | King | 131/187 |

FOREIGN PATENT DOCUMENTS

| | | | |
|---|---|---|---|
| 690864 | 4/1953 | United Kingdom | 131/257 |

*Primary Examiner*—Stanley S. Silverman
*Assistant Examiner*—Dionne A. Walls
*Attorney, Agent, or Firm*—Michael I. Kroll

[57] ABSTRACT

The present invention 10 discloses a mechanism for holding cigars and/or cigarettes 14 and pipes 34 having a first spring clamping member 16 on one end for holding the cigar 14 being connected intermediately to a second spring member 24 wherein said second spring member 24 can be temporarily clamped onto an object for holding the present invention 10. This allows the present invention 10 to be easily moved from one object such as a golf cart 12, a handrail 26, golf bag 32 or other object to another. Alternative means for intermediately connecting the opposite clamping members 16, 24 are disclosed being a spring like flexible member 20 having a rubber sheath 22 about it, a 360 degree rotatably mounted member 38 and, additionally, a rivet shaped member 38 allowing rotation between the first spring holding member 16 and the second anchoring spring member 24.

12 Claims, 7 Drawing Sheets

46
44
40
16
38
10
24
42

PLIABLE DUAL CLAMPING CIGAR/ CIGARETTE HOLDER

BACKGROUND OF THE INVENTION

1. Field of the Invention

The present invention relates generally to cigarette/cigar holders and, more specifically, to a device having a first spring clamp and a second spring clamp having connection means therebetween comprising an elongated spring having a rubber-like sheathing which will maintain selective positioning. Said first holding spring clamp having a first segment comprising opposed divergent leg members each having a second segment angularly projecting inward and parallel each other and each having a transversely biased third segment formed into parallel abutting semi-cylindrical gripping members. Said first segments being tensionally movable toward each other causing said third segments to move outwardly allowing insertion or removal of said cigarette, cigar, or pipe. Said second anchoring spring clamp, being attached to the opposite distal end of said elongated spring having a rubber-like sheathing, and having opposed divergent leg members each having a second segment angularly projecting inward and parallel each other and each having a transversely biased third segment each being formed into elongated rectangularly-shaped parallel gripping members whereby when said second clamp first segments are compressed towards each other said second spring third segments move outwardly allowing clamping attachment to any object having the ability to maintain said second clamping placement.

In addition, there is provided an alternate embodiment wherein each clamp is formed to the same shape as previously stated and wherein said first segments having a common connecting member which is wrapped around a bar having a head on each distal end and wherein said planar surface formed by either head is transverse the planar surface formed by said first segments.

There is provided an additional alternate embodiment wherein each clamp is formed to the same shape as previously stated and wherein said first segments having a common connecting member which is wrapped around a bar having a head on each distal end and wherein said planar surface formed by either head is parallel with the planar surface formed by said first segments.

2. Description of the Prior Art

There are other holders designed to temporarily hold cigars and cigarettes. Typical of these is U.S. Pat. No. 5,524,646 issued to Reich on Jun. 11, 1996.

Another patent was issued to Ford on Feb. 28, 1956 as U.S. Pat. No. 2,736,322. Yet another U.S. Pat. No. 1,936,431 was issued to Halapleus on Nov. 21, 1933 and still yet another was issued on Jan. 5, 1932 to Rinne as U.S. Pat. No. 1,840,255.

U.S. Pat. No. 5,524,646

Inventor: Gregory H. Reich

Issued: Jun. 11, 1996

A cigar/cigarette holder for allowing a user to temporarily secure a cigar or a cigarette to a proximal object including a clamp having a pair of arms positioned in opposition about a common axis of symmetry and a spring mechanism for biasing the arms toward each other; a container for holding a plurality of cigars or cigarettes; a coupling mechanism for removably coupling the container to the clamp and for allowing axial rotation of the arms about the common axis of symmetry; and a plurality of generally parallel and connected tubes coupled to the container for removably holding cigars or cigarettes.

U.S. Pat. No. 2,736,322

Inventor: C. A. Ford

Issued: Feb. 28, 1956

This United States Patent discloses a cigarette holding tongs comprising a one piece body formation produced from stiff springy wire doubled upon itself to provide a pair of leg members tensionally biased for relative outward movement, said leg members terminating in inwardly projecting and lapped arms, opposed arcuate cigarette gripping jaw portions dependant from said arms to lie intermediate said leg members and to be yieldably biased by the latter for movement one toward the other and said jaw portions terminating in crossed and lapped outwardly bowed tail piece.

U.S. Pat. No. 1,936,431

Inventor: J. G. Halapleus

Issued: Nov. 21, 1933

This United States Patent discloses a cigarette holder device having outwardly extending divergent arms, an elongated semi-cylindrical cigarette engaging portion on the outer end of each arm and extending at substantially right angles to said arms, said cigarette engaging portions adapted to abut each other so as to merge into an unbroken surface, a substantially circular handle portion in the inner ends of said arms, the axis of said handle portion being parallel to the axis of said semi-cylindrical portions, and a longitudinally elongated fin on the outer side of each semi-cylindrical portion arranged in diametrically opposed relation to each other and having its ends spaced from the ends of said semi-cylindrical portions.

U.S. Pat. No. 1,840,255

Inventor: K. Rinne

Issued: Jan. 5, 1932

This United States Patent discloses a combined holder and snuffer for cigarettes comprising a pair of resilient arms, a semi-circular shiftable combined clamping and snuffer element integral with and offset with respect to the outer end of each arm, said elements being interengaged and oppositely disposed relatively to each other, one of said elements having a slot for the passage therethrough of the other of said elements, the said element formed with the slot provided with means for arresting the shifting movement in opposite directions of said elements relatively to each other.

While these cigar/cigarette holder devices may be suitable for the purposes for which they were designed, they would not be as suitable for the purposes of the present invention, as hereinafter described.

SUMMARY OF THE PRESENT INVENTION

The present invention discloses a mechanism for holding cigars, cigarettes, and/or pipes having a first spring clamping member on one end for holding the cigar being connected intermediately to a second spring member wherein said second spring member can be temporarily clamped onto an object so that the present invention can be easily moved from one object such as a golf cart, a handrail, golf bag or other object to another. Alternative means for intermediately connecting the opposite clamping members are disclosed being a spring like flexible member having a rubber sheath about it, a 360 degree rotatable mounted member and, additionally, a rivet shaped member allowing rotation between the first spring holding member and the second anchoring spring member.

A primary object of the present invention is to provide a portable dual spring clamp cigar, cigarette and pipe holder.

Another object of the present invention is to provide a portable dual spring clamp cigar, cigarette and pipe holder having a first holding clamp and a second anchoring clamp;

Yet another object of the present invention is to provide a portable dual spring clamp cigar, cigarette and pipe holder having a first holding clamp with semi-cylindrical abutting gripping members;

Still yet another object of the present invention is to provide a portable dual spring clamp cigar, cigarette and pipe holder having a second anchoring clamp with elongated rectangularly-shaped parallel gripping members;

Yet another object of the present invention is to provide a portable dual spring clamp cigar, cigarette and pipe holder having a first holding clamp and a second anchoring clamp having connection means therebetween comprising an elongated spring having a rubber-like sheathing which will maintain selective positioning;

Still yet another object of the present invention is to provide a portable dual spring clamp cigar, cigarette and pipe holder having a first holding clamp and a second anchoring clamp each independently axially rotatable.

Additional objects of the present invention will appear as the description proceeds.

The present invention overcomes the shortcomings of the prior art by providing a device having a first holding spring clamp and a second anchoring spring clamp having connection means therebetween comprising an elongated spring having a rubber-like sheathing which will maintain selective positioning.

In addition, there is provided alternate embodiments having a first holding spring clamp and a second anchoring spring clamp wrapped around a rivet-like member wherein said clamps are independently axially rotatable.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
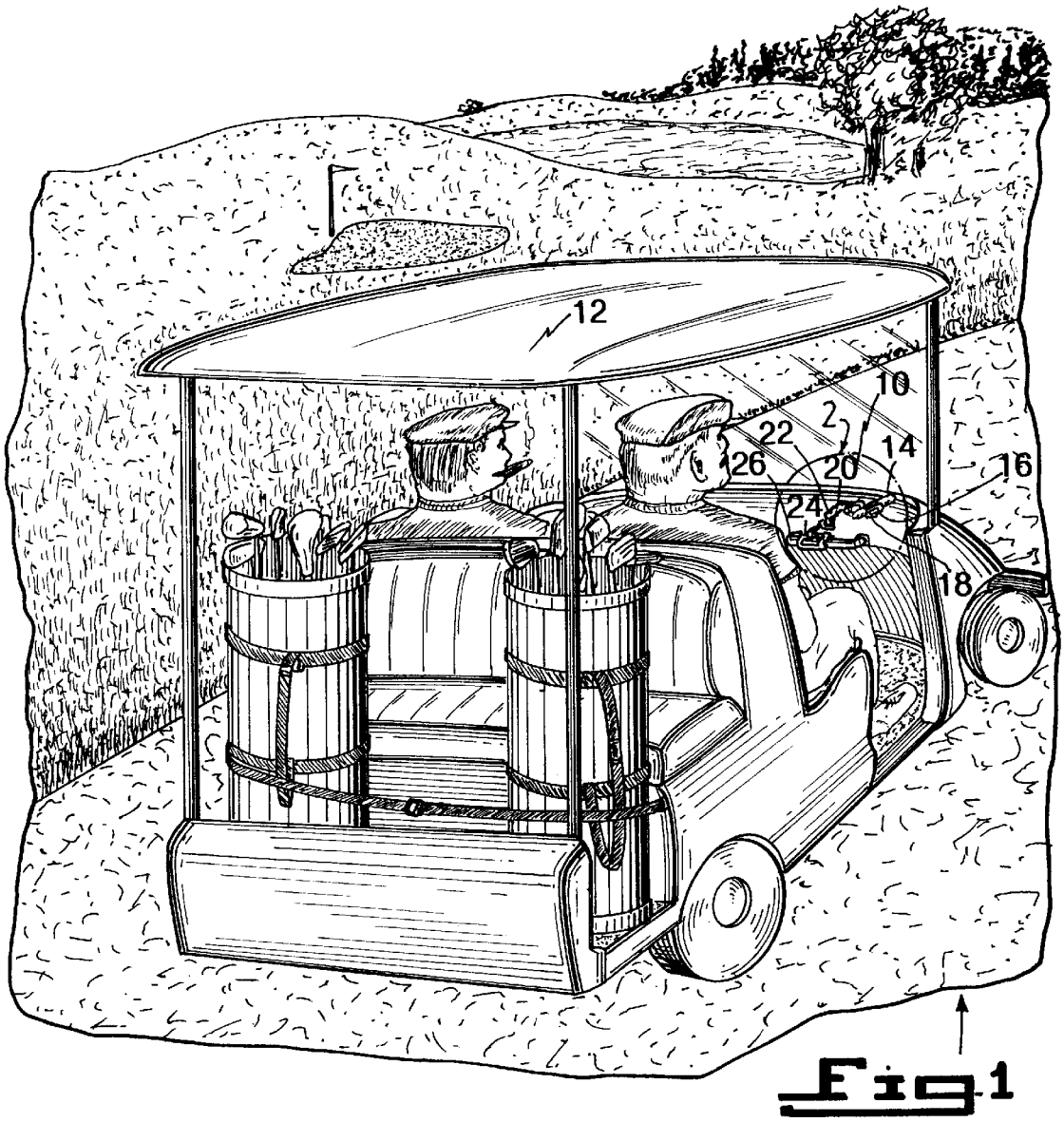
FIG. 1 is a perspective view of the preferred embodiment of the present invention in use. Shown is a lit cigar being held by compression within a first holding spring clamp having semi-cylindrical gripping members and connected by a flexible spring being sheathed in a rubber-like substance to a second anchoring spring clamp attached to a bar within a golf cart.

With regard to the reference numerals used, the following numbering is used throughout the various figures.

10 present invention
12 golf cart
14 cigar
16 first holding spring member
18 first gripping member
20 flexible spring
22 rubber sheath
24 second anchoring spring member
25 second gripping member
26 handrail
28 hand
30 horizontal surface
32 golf bag
34 pipe
36 alternate locations
38 center member
40 center member recess
42 lawn chair
44 wrap of first spring member
46 wrap of second spring member

DESCRIPTION OF THE PREFERRED EMBODIMENT(S)

Turning now descriptively to the drawings, in which similar reference characters denote similar elements throughout the several views, FIGS. 1 through 11 illustrate the present invention being a holder for cigars, cigarettes and/or pipes.

Turning to FIG. 1, therein is shown a perspective view of the preferred embodiment of the present invention 10 in operative connection with a golf cart 12. Shown is a lit cigar 14 held by compression within a first holding spring clamp 16 having semi-cylindrical gripping members 18 which connect by a flexible spring 20 being sheathed in a rubber-like substance 22 to a second anchoring spring clamp 24 attached to a bar or handrail 26 within the golf cart 12.

Figure 2:
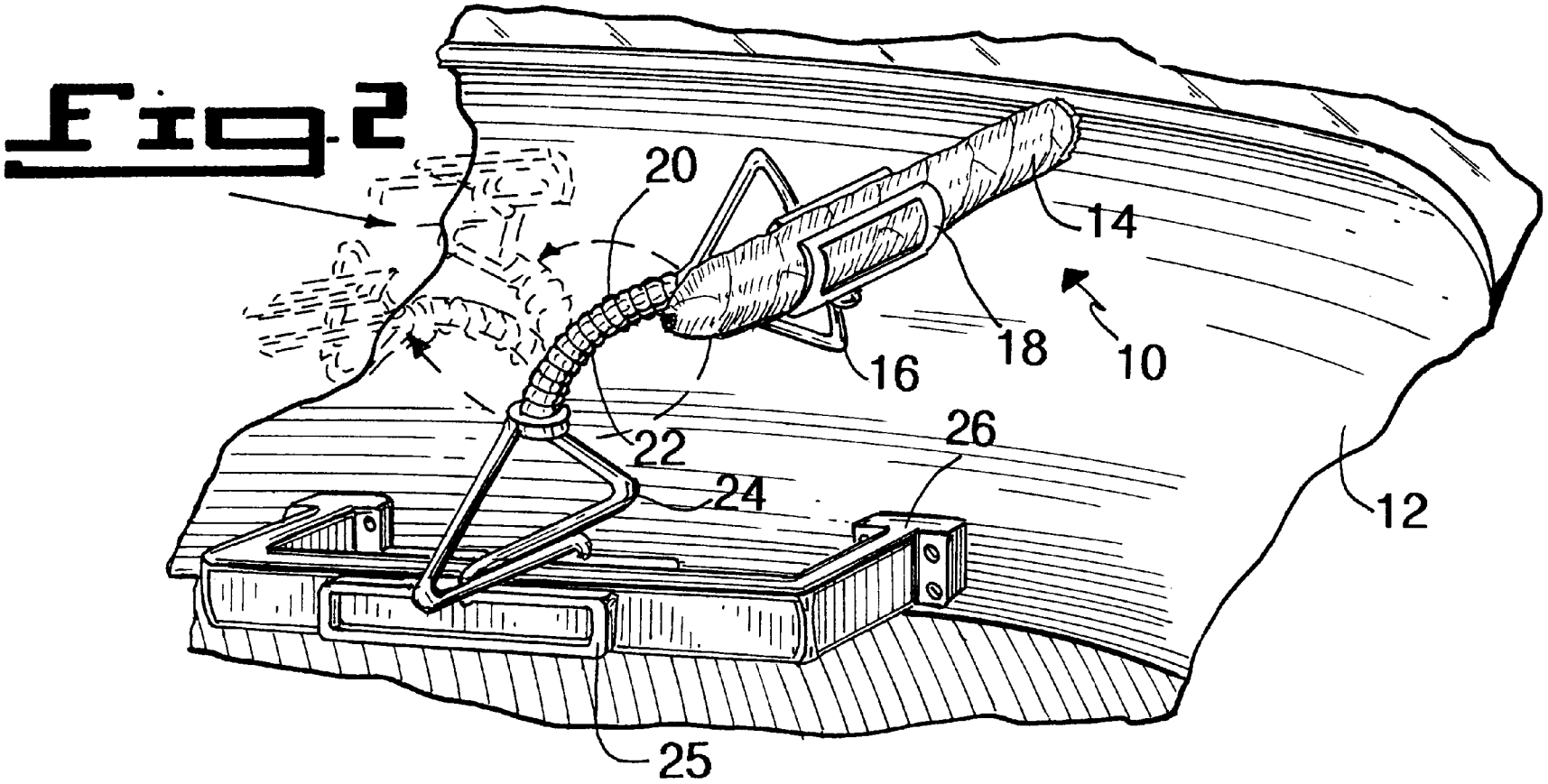
FIG. 2 is an enlarged perspective view of the preferred embodiment of the present invention, taken from FIG. 1 as indicated, showing the integral dual clamping cigar holder second clamping means attached to a bar and the first clamping means having a cigar therein whereby said lit cigar can be safely held until retrieved by the smoker. Also shown in dotted line are some of the alternate locations of said first clamping means and said cigar achieved through bending and twisting of the flexible connection member.

Turning to FIG. 2, therein is shown an enlarged perspective view of the preferred embodiment of the present invention 10 taken from FIG. 1 as indicated. Therein is shown a perspective view of the preferred embodiment of the present invention 10 in operative connection with a golf cart 12. Shown is a lit cigar 14 held by compression within a first holding spring clamp 16 having semi-cylindrical gripping members 18 which connect intermediately to a flexible spring 20 being sheathed in a rubber-like substance 22 to a second anchoring spring clamp 24 attached to a bar or handrail 26 within the golf cart 12. The second rectangularly shaped gripping member 25 is also shown. The first and second spring members 16, 24 each comprise a pair of arms positioned in opposition to each other about a common axis having a spring mechanism for biasing said pair of arms toward each other.

Figure 3:
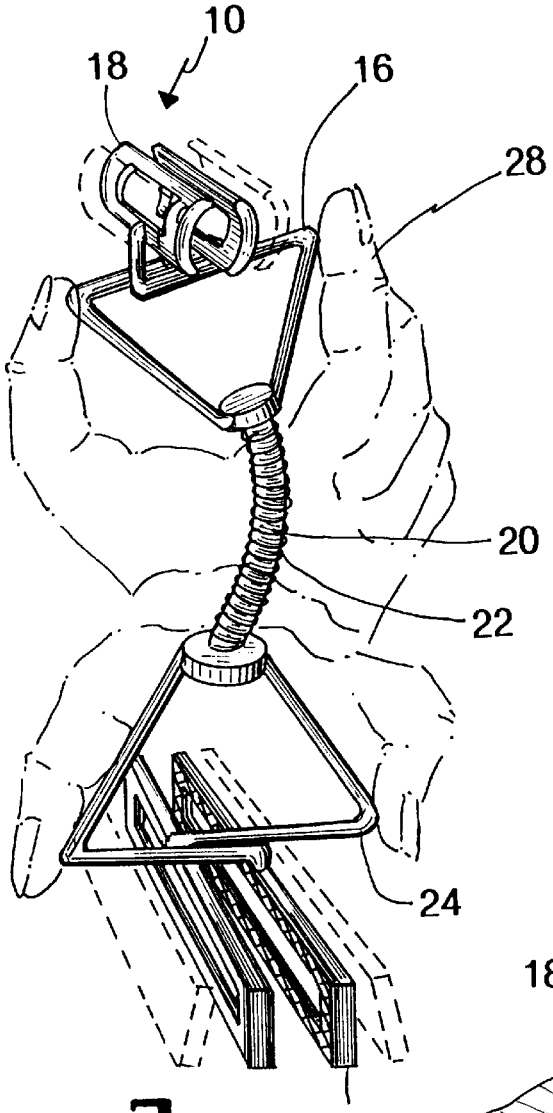
FIG. 3 is an enlarged perspective view of the preferred embodiment of the present invention showing a hand in outline indicating the method of operation of the first holding clamp and the second anchoring clamp.

Turning to FIG. 3, therein is shown an enlarged perspective view of the preferred embodiment of the present invention 10 showing a hand 28 in outline indicating the method of operation of the first holding clamp 16 and the second anchoring clamp 24. As can be seen, the first and second anchoring clamps 16, 24 operate by grasping opposing sides of the spring clamp and pushing with the fingers the springs toward each other which then spreads the gripping members 18, 25 apart from each other.

Figure 4:
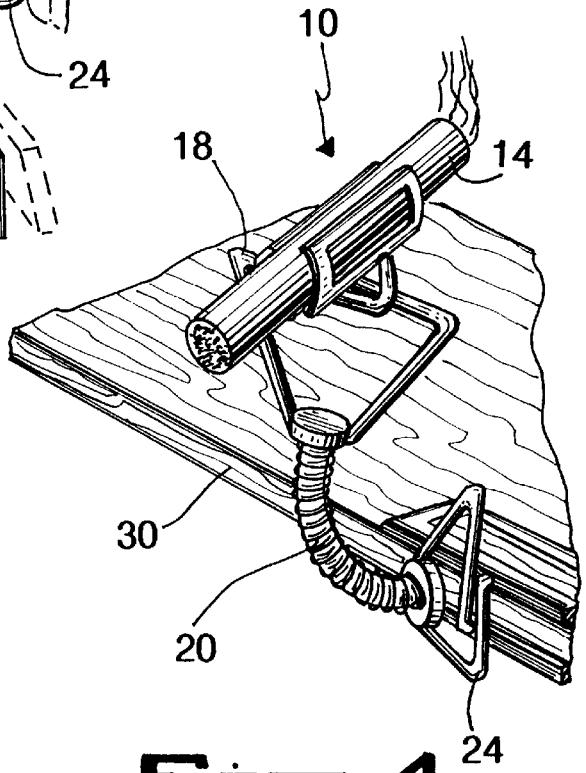
FIG. 4 is an enlarged perspective view of the preferred embodiment of the present invention showing the versatility of the flexible connection means whereby the second anchoring clamp is attached to the edge of a horizontal surface and the first holding clamp having a cigarette parallel to said surface.

Turning to FIG. 4, therein is shown an enlarged perspective view of the preferred embodiment of the present invention 10 showing the versatility of the flexible connecting means 20 whereby the second anchoring clamp 24 is attached to the edge of a horizontal surface 30 and a first holding clamp 18 holding a cigarette 14 parallel to said horizontal surface.

Figures 5, 6:
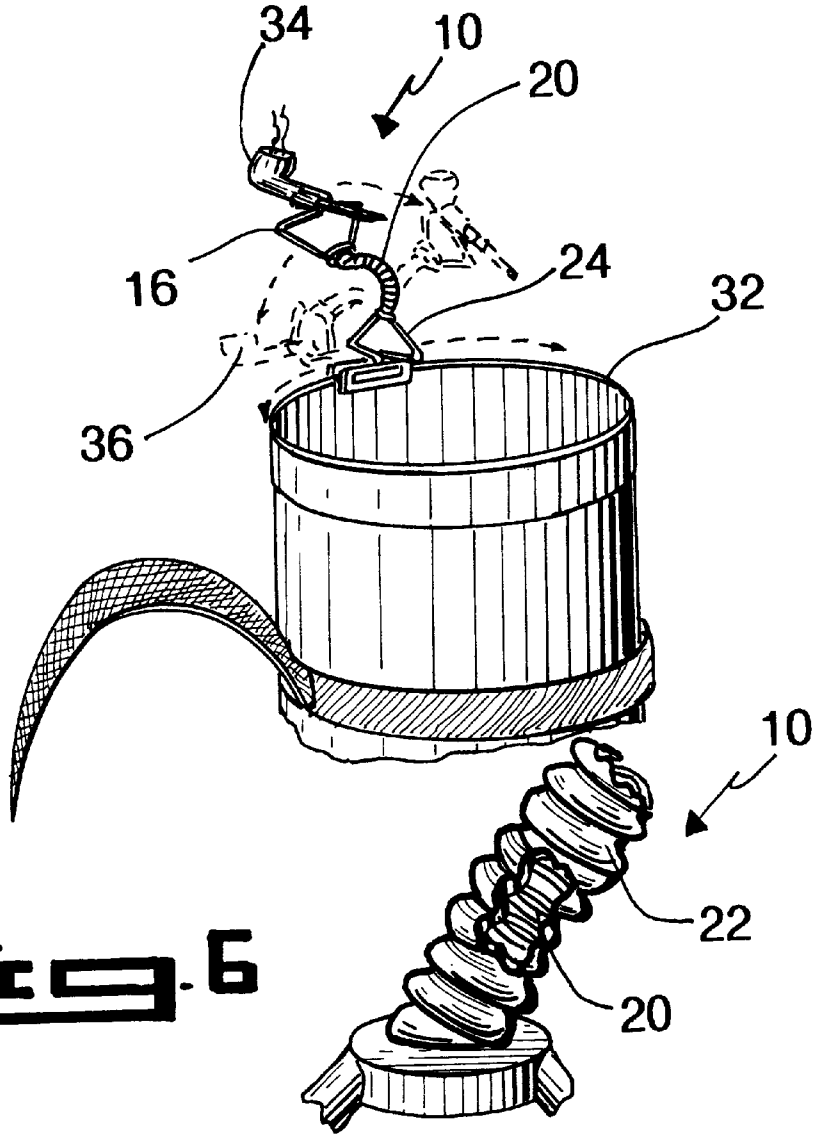
FIG. 5 is an enlarged perspective view of the preferred embodiment of the present invention, showing the integral dual clamping holder second anchoring clamp attached to a golf bag and the first holding clamp having a pipe therein whereby said lit pipe can be safely held until retrieved by the smoker. Also shown in dotted line are various alternate locations of said first clamping means and said pipe achieved through bending and twisting of the flexible connection member.
FIG. 6 is a partial sectional view of the flexible connection member of the preferred embodiment of the present invention showing a rubber-like sheath covering an internal spring.

Turning to FIG. 5, therein is shown an enlarged perspective view of the preferred embodiment of the present invention 10, showing the integral dual clamping holder, with the second anchoring clamp 24 attached to a golf bag 32 and the first holding clamp 16 having a pipe 34 therein whereby said lit pipe 34 can be safely held until retrieved by the user. Also shown in dotted line are various alternate locations 36 which said first clamping member 16 and said pipe 34 achieve through bending and twisting of the flexible connecting spring or member 20.

Turning to FIG. 6, therein is shown a partial sectional view of the flexible connecting spring member 20 of the preferred embodiment of the present invention 10 showing the rubber-like sheath 22 covering an internal spring 20.

Figure 7:
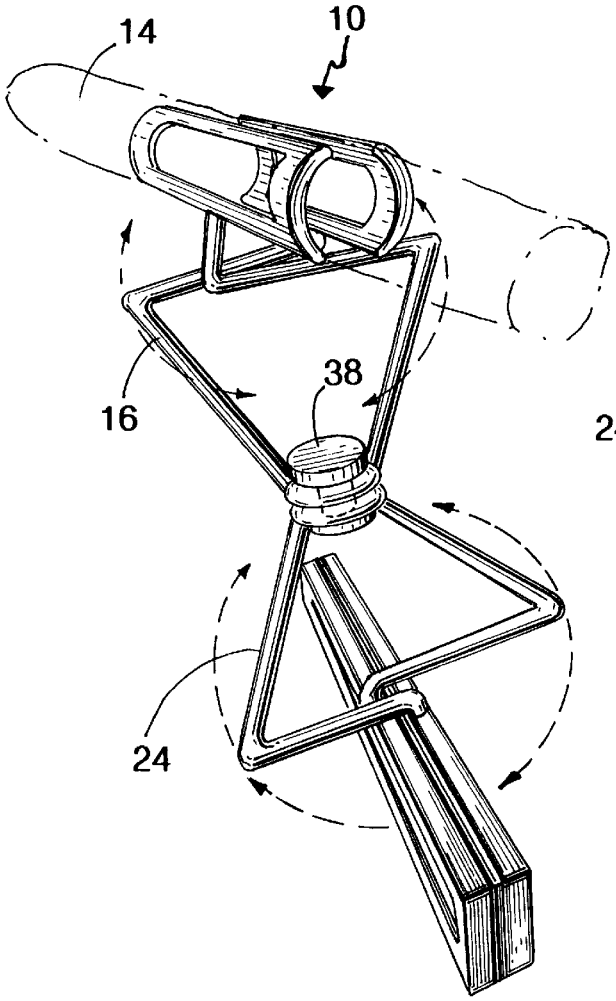
FIG. 7 is a perspective view of an alternate embodiment of the present invention showing the first and second clamping means attached to a rivet-like center member wherein one or both of said clamps can be rotated 360 degrees. Also shown in outline is a cigar being held with the first holding clamp member.

Turning to FIG. 7, therein is shown a perspective view of an alternative embodiment of the present invention 10 showing the first and second clamping means 16 and 24, attached to a rivet-like center member 38 so that one or both of said clamps can be rotated 360 degrees. Also shown in outline is a cigar 14 being held with the first holding clamp member 16.

Figure 8:
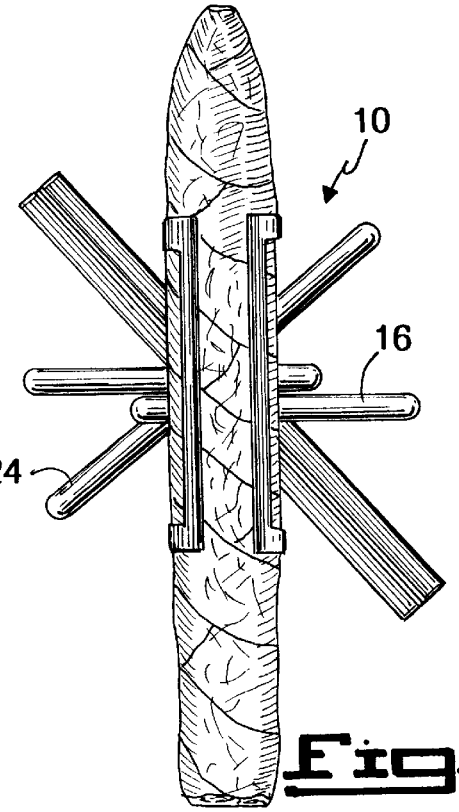
FIG. 8 is a top plan view of the alternate embodiment of the present invention shown in FIG. 7 wherein the cigar holding first clamp is rotated 45 degrees to the second anchoring clamp.

Turning to FIG. 8, therein is shown a top plan view of the alternate embodiment of the present invention 10 shown in FIG. 7 wherein the cigar holding first clamp 16 is rotated 45 degrees from the second anchoring clamp 24.

Figure 9:
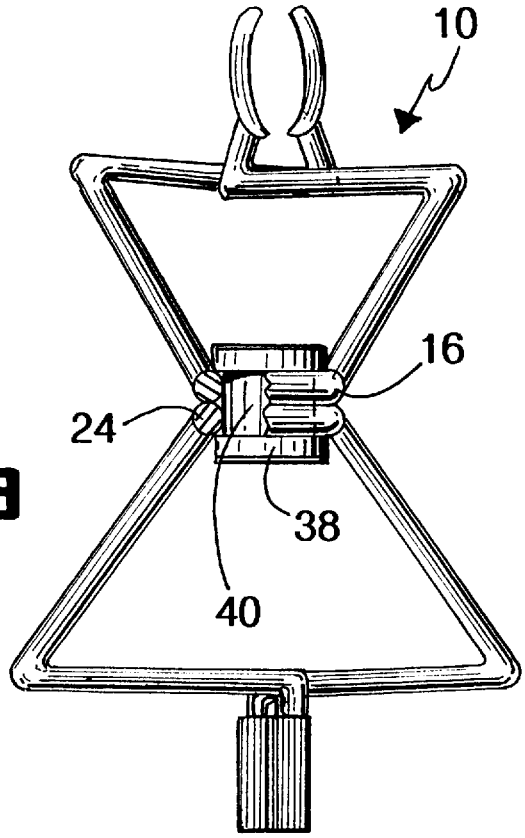
FIG. 9 is a front elevational view of the alternate embodiment of the present invention shown in FIGS. 7 and 8 having a cutaway view of the clamping members showing the rivet-like connection member.

Turning to FIG. 9, therein is shown a front elevation view of the alternate embodiment of the present invention 10 shown in FIGS. 7 and 8 showing a cut-away view of the clamping members 16 and 24 showing the rivet-like connection center member 38. As can be seen, the center member 38 is simply a cylindrically shaped member having a recessed area 40 located about its center wherein the ends of the first holding spring member 16 and the second anchoring spring member 24 are wrapped around said center member 38 and located in the recessed area 40 thereby allowing 360 degree rotation about said center member 38. Note that the longitudinal axis of the center member 38 is parallel to the plane of the first and second clamping members 16 and 24.

Figure 10:
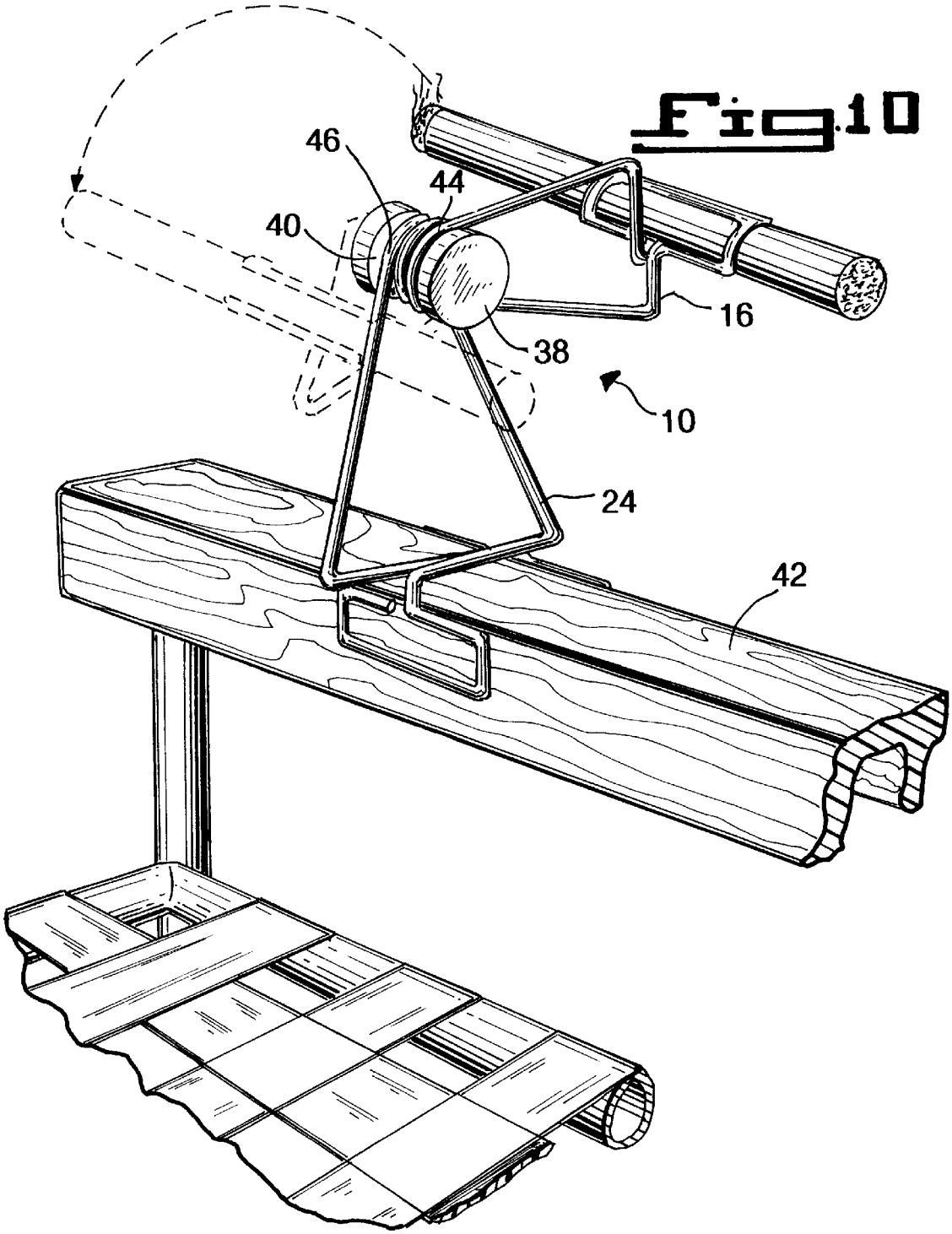
FIG. 10 is a perspective view of an additional embodiment of the present invention showing the integral dual clamping holder attached to a lawn chair. Shown are the first and second clamp members attached to a rivet-like center member wherein the same planar surfaces is created by the head of the rivet and the leg members.

Turning to FIG. 10, therein is shown a perspective view of an additional embodiment of the present invention 10 showing the integral dual clamping holder 24 attached to a lawn chair 42. Shown are the first 16 and second 24 clamp members attached to a rivet-like center member 38 wherein the first and second clamp members 16, 24 are wrapped around the center member 38 at 44 and 46 respectively. Note that the longitudinal axis of the center member 38 is perpendicular to the plane of the clamping members 16 and 24.

Figure 11:
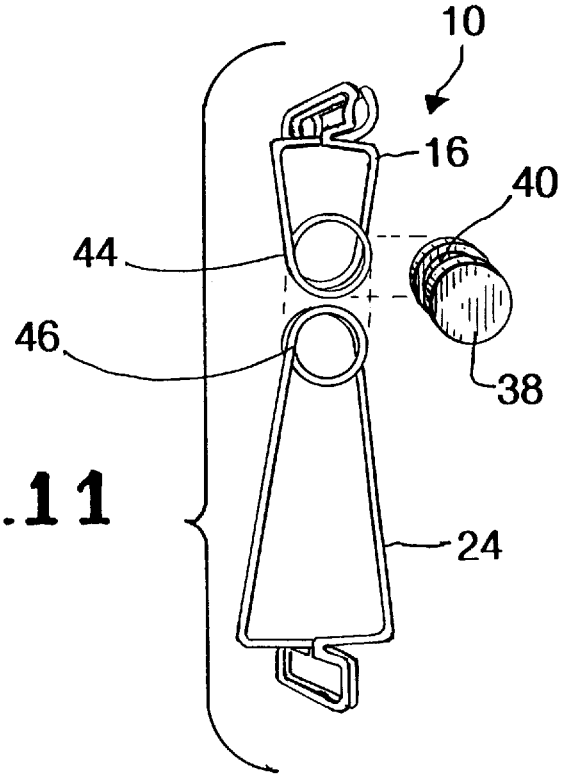
FIG. 11 is an exploded view of the additional alternate embodiment of the present invention shown in FIG. 10. Shown are the first clamping member and the second clamping member and the rivet-like connection means for said clamps.

Turning to FIG. 11, therein is shown an exploded view of the additional alternate embodiment of the present invention shown in FIG. 10. Shown are the first clamping member 16 and the second clamping member 24 and the rivet-like connection means 38 for said clamps and its recess 40. The wraps 44, 46 of the first and second clamp members are also shown.

What is claimed is new and desired to be protected by Letters Patent is set forth in the claims:

1. An apparatus for holding cigarettes and/or cigars, comprising:

a) a first cigarette holding spring member;

b) a second anchoring spring member; and c) an intermediate connecting member connecting said first spring member and second spring member, wherein said intermediate connecting member further comprises a center member, said center member including a cylindrically shaped member having a recessed area in its body whereby said first and second spring members are connected to each other.

2. The apparatus of claim 1, wherein said intermediate connecting member includes a third flexible spring member.

3. The apparatus of claim 1, wherein said intermediate member further comprises a center member allowing 360 degree rotation.

4. The apparatus of claim 1, wherein said first holding spring member is semi-cylindrically shaped.

5. The apparatus of claim 1, wherein said second anchoring spring member is rectangularly shaped.

6. The apparatus of claim 2, wherein said spring member further comprises a rubber covering.

7. An apparatus for holding cigarettes and/or cigars, comprising:

a) a first cigarette holding spring member;

b) a second anchoring spring member;

c) said first spring member further comprising a semi-cylindrically shaped cigarette gripping member;

d) said second anchoring spring member further comprising a rectangularly shaped object gripping member; and e) said first cigarette holding spring member and said second anchoring spring member further comprising means for connecting to each other, wherein said first and second spring members each comprise a pair of arms positioned in opposition to each other about a common axis having a spring mechanism for biasing said pair of arm toward each other, said means for connecting further comprises a center member having means for 360 degrees rotation and a cylindrically shaped member having a recessed area in its body whereby said first and second spring members are connected to each other.

8. The apparatus of claim 7, said means for connecting said first and second spring members further comprises a flexible spring member.

9. The apparatus of claim 7, said cylindrically shaped member further comprises its longitudinal axis being parallel to the plane of said first and second spring members.

10. The apparatus of claim 7, said cylindrically shaped member further comprises its longitudinal axis being perpendicular to the plane of said first and second spring members.

11. The apparatus of claim 8, said flexible spring further comprising a rubber covering.

12. The apparatus of claim 10, wherein rotation is provided between said first and second spring members.

* * * * *